US005661749A

United States Patent [19]

Hayashi

[11] Patent Number: 5,661,749

[45] Date of Patent: Aug. 26, 1997

[54] BRIDGING PROTECTION APPARATUS FOR AN INDUCTION FURNACE

[75] Inventor: Shizuo Hayashi, Kawasaki, Japan

[73] Assignee: Fuji Electric Co., Ltd., Kanagawa, Japan

[21] Appl. No.: 527,460

[22] Filed: Sep. 13, 1995

Related U.S. Application Data

[62] Division of Ser. No. 115,004, Sep. 1, 1993, Pat. No. 5,479,437.

[30] Foreign Application Priority Data

Sep. 3, 1992 [JP] Japan ..... 4-235015

[51] Int. Cl.[6] ..... H05B 6/06

[52] U.S. Cl. ..... 373/145; 373/148; 373/150

[58] Field of Search ..... 373/145, 147, 373/148, 149, 151, 102; 219/660, 661, 663, 664, 665, 668; 164/503

[56] References Cited

U.S. PATENT DOCUMENTS 4,289,946 9/1981 Yarwood et al. ..... 164/503

4,327,268 4/1982 Frank ..... 219/660

4,897,518 1/1990 Mucha et al. ..... 219/660

*Primary Examiner*—Tu B. Hoang

*Attorney, Agent, or Firm*—Finnegan, Henderson, Farabow, Garrett & Dunner, L.L.P.

[57] ABSTRACT

Temperature sensors are embedded in a refractory material that make up the walls of a body of an induction furnace and detect an increase in the temperature of a molten metal in the body of the furnace due to the bridging of a metal material that is to be melted in the furnace body. The temperature sensors are connected to an antenna for detecting runout. Since various electrical data (voltage, current, power, frequency, etc.) that affect an alternating current to be supplied to a coil of the induction furnace change depending on the temperature of the molten metal, bridging of the metal material is detected by determining the rates of temporal change in these electrical data. Furthermore, the changes in the electrical data with respect to the progress of the operation of the induction furnace are previously stored in data storage, and the electrical data stored are compared with electrical data detected in the induction furnace in operation. An alarm is given when the deviation of the detected electrical data from the stored electrical data is kept larger than a predetermined value for a predetermined time period.

2 Claims, 12 Drawing Sheets

BRIDGING PROTECTION APPARATUS FOR AN INDUCTION FURNACE

This is a division of application Ser. No. 08/115,004, filed Sep. 1, 1993 now U.S. Pat. No. 5,479,437.

BACKGROUND OF THE INVENTION

1. Field of Invention

This invention relates to a bridging protection apparatus for an induction furnace which prevents the wall of the induction furnace from being damaged by bridging of a metal material to be melted in the furnace.

2. Description of Related Art

FIG. 14 is a diagram showing the configuration of a conventional induction furnace having a runout detection device. As shown in FIG. 14, the body of the induction furnace is made of a refractory material 5. To the outer periphery of the refractory material 5, a heat insulating material 6 is attached, so that the refractory material 5 and the heat insulating material 6 constitute a furnace wall. A coil 8 through which a large current can flow is wound around the outer periphery of the furnace body when an alternating current (AC current) flows through the coil 8, a current is induced by electromagnetic induction in a metal material 3 to be melted and in a molten metal 2, thereby heating the metal material 3 and the molten metal 2. As a result, the metal material 3 melts and the temperature of the molten metal 2 rises. Since a large current of several thousands to tens of thousands amperes usually flows through the coil 8, the coil 8 is constructed of a hollow conductor provided with an inner passage for allowing cooling water to flow therethrough, thereby suppressing the temperature rise of the coil 8.

The refractory material 5 is gradually damaged when it is used for a long time. When the temperature of the molten metal 2 becomes extremely high, however, the refractory material 5 is damaged rapidly, thereby causing a runout accident, i.e., causing the molten metal 2 to leak out. Thus, the induction furnace is provided with a runout detection device which comprises first and second antennas 11 and 12 connected to each other through a detection power source 13 and a runout detector 14. The second antenna 12 is insulated with an insulating material 7 and disposed between the outer periphery of the furnace body and the coil 8. The first antenna 11 is disposed at the bottom of the furnace so that the first antenna 11 is brought in contact with the molten metal 2. When the molten metal 2 leaks out due to wear of the refractory material 5 to contact with the second antenna 12, therefore, a current flows from the detection power source 13 to the runout detector 14 and then through the second antenna 12, the molten metal 2 and the first antenna 11, and back to the detection power source 13. This current flow actuates the runout detector 14, thereby closing a runout alarm contact 14A resulting in an alarm that acts as notification that there is runout.

FIG. 15 is a circuit diagram showing a conventional electric circuit of the induction furnace. In FIG. 15, an AC power is supplied from an AC power source 20 to an inverter unit 23 through a circuit breaker 21 and a transformer 22. The inverter unit 23 which comprises a rectifier 23R, a DC reactor 23L and a thyristor inverter 23S converts an input AC current into an AC current having a desired frequency. The converted AC current is supplied to the coil 8 of the induction furnace. A voltage detector 24, a voltage controller 26 connected thereto, a current detector 25, and a current controller 27 connected thereto are provided in the primary side of the transformer 22 in order to limit the levels of the voltage and current to be supplied to the coil 8 so as not to exceed a predetermined value.

FIG. 16 is a graph showing the operating characteristics of the induction furnace. The abscissa indicates a current, and the ordinate indicates a voltage. $I_L$ represents a current limiting value set by the current controller 27 shown in FIG. 15, and $V_L$ represents a voltage limiting value set by the voltage controller 26. At the beginning of its operation, the induction furnace exhibits the operating characteristics indicated by the straight line A in the graph. This means that a current can readily flow through the metal material 3 or the molten metal 2 because the temperature thereof is low. As the temperature rises, however, it becomes difficult for a current to flow through the metal material 3 or the molten metal 2. Thus, with the elapse of time, the operating characteristics gradually change into the state indicated by the straight line D.

As described above, in order to start the operation of the induction furnace, a metal material 3 is first fed into the furnace, and then an AC current is allowed to flow through the coil 8, so that the metal material 3 is heated to melt into a molten metal 2 by electromagnetic induction. When the temperature of the thus obtained molten metal 2 rises, the metal material 3 is further supplied through the top of the furnace into the molten metal 2. This causes the temperature of the molten metal 2 to be temporarily lowered. When the temperature of the molten metal 2 rises again by electromagnetic induction, the metal material 3 is further supplied through the furnace top into the molten metal 2. In this process, the following are repeated. As described above, the operating characteristics shown in the graph of FIG. 16 first change from the state of the straight line A to that of the straight line D. When the metal material 3 is supplied into the molten metal 2 to lower the temperature thereof, the operating characteristics return to the state of the straight line A, and then gradually change again into the state of the straight line D with an increase in the temperature of the molten metal 2.

FIG. 17 is a diagram showing the configuration of the induction furnace in which bridging of a metal material has occurred. As shown in FIG. 17, the lumps of the metal material 3 supplied through the furnace top have been intertwined to keep them from falling into the molten metal 2, i.e., bridging of the metal material 3 has occurred. In the case of such bridging, the electric power supplied to the induction furnace is supplied to the molten metal 2, but it is not supplied to the metal material 3 in the state of bridging. Thus, the temperature of only the molten metal 2 rises, sometimes to 2,000° C. in the worst case. At such a high temperature, the refractory material 5 is rapidly worn, thereby causing the danger of a runout accident. When such runout causes the coil 8 to break, the leaked molten metal 2 may come into contact with the cooling water in the coil 8, thereby causing the danger of a steam explosion. Even if a runout accident does not occur, the metal material 3 in the state of bridging may collapse and fall into the molten metal 2 heated to an extremely high temperature, whereby a gas may be rapidly generated to blow up the molten metal 2. In the case of a closed induction furnace, there is danger of explosion due to the pressure of the generated gas.

The only available way of finding out whether bridging of the metal material 3 has occurred or not is the visual inspection of the status of the furnace. However, it is difficult and dangerous to constantly perform the visual inspection of the status of bridging in the poor work environment. Furthermore, in the case of a closed-type induction furnace

BRIEF DESCRIPTION OF THE DRAWINGS

FIG. 13 is a circuit diagram showing a ninth embodiment of the invention;

DETAILED DESCRIPTION OF THE PREFERRED EMBODIMENTS

Figure 1:
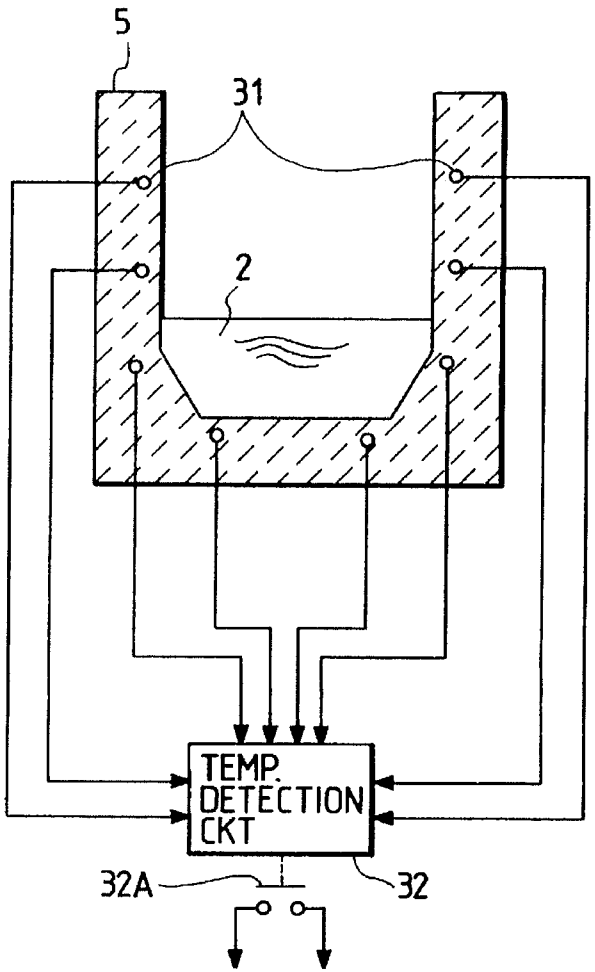
FIG. 1 is a diagram showing the configuration of an induction furnace including a first embodiment of the invention.
Figure 14:
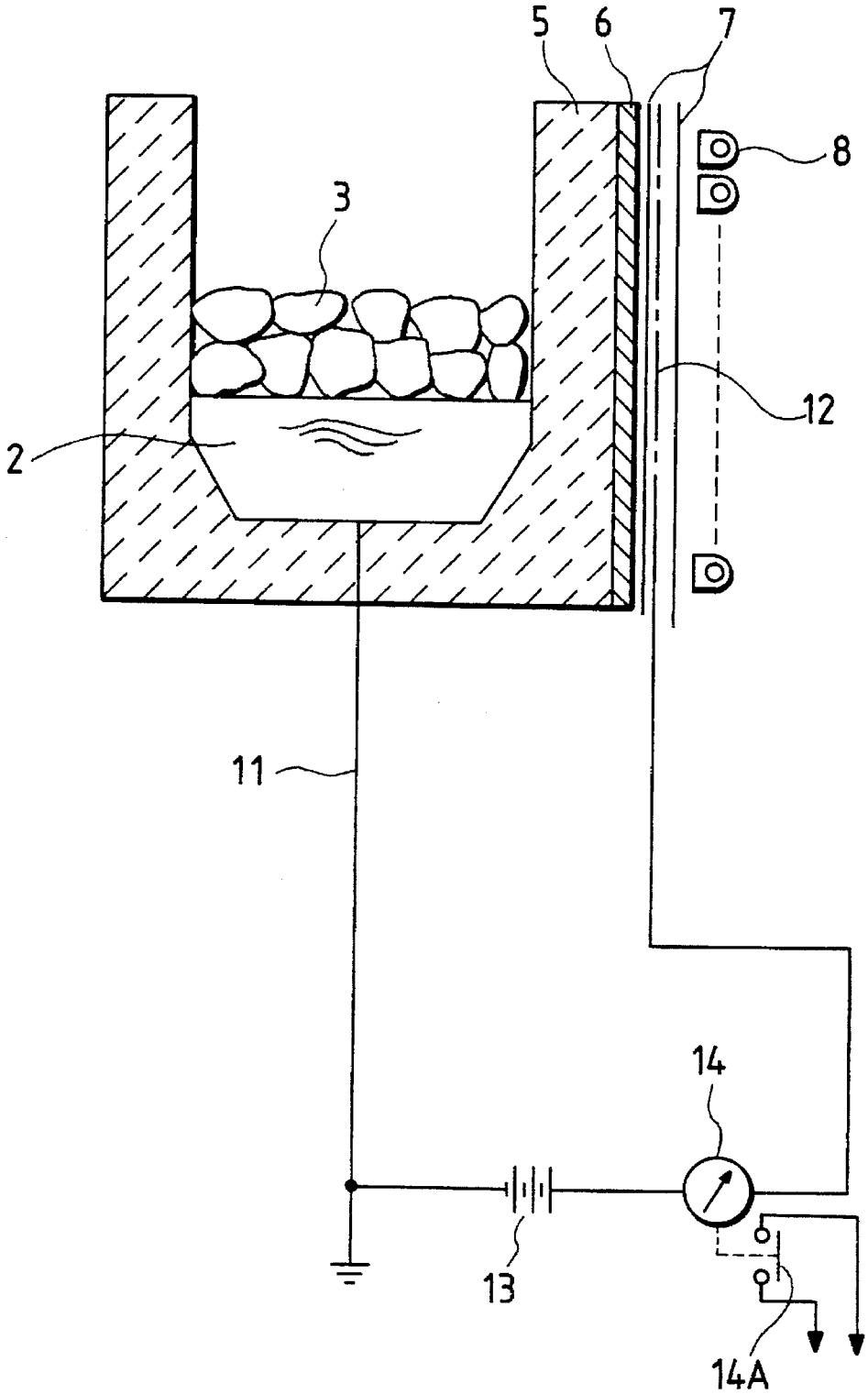
FIG. 14 (PRIOR ART)
FIG. 14 is a diagram showing the configuration of a prior art example of an induction furnace including a runout detection device.
Figure 17:
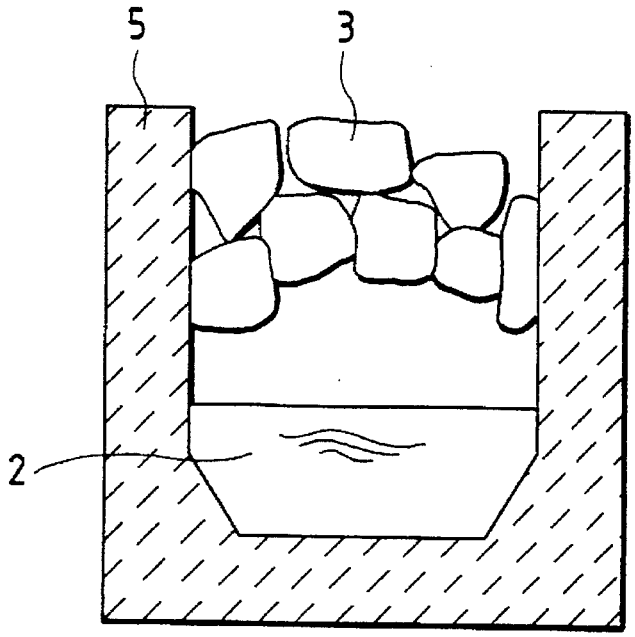
FIG. 17 (PRIOR ART)
FIG. 17 is a diagram showing the configuration of the induction furnace in which bridging has occurred.

FIG. 1 is a diagram showing the configuration of an induction furnace according to a first embodiment of the invention. Since this embodiment is irrelevant to the above-described metal material 3, heat insulating material 6, insulating material 7, coil 8, first antenna 11, second antenna 12, detection power source 13, runout detector 14 and runout alarm contact 14A in the conventional furnace of FIG. 14, these components are not shown in FIG. 1.

In the first embodiment, a plurality of temperature sensors 31 are embedded in a refractory material 5 constituting the body of the furnace. A temperature detection circuit 32 monitors temperature signals transmitted from the temperature sensors 31. When bridging arises, the electric power is supplied only to the molten metal 2, whereby its temperature is raised as described above. When the temperature detection circuit 32 judges that the temperature detected by at least one of the temperature sensors 31 exceeds a predetermined value, a temperature alarm contact 32A is actuated to give an alarm.

Figure 2:
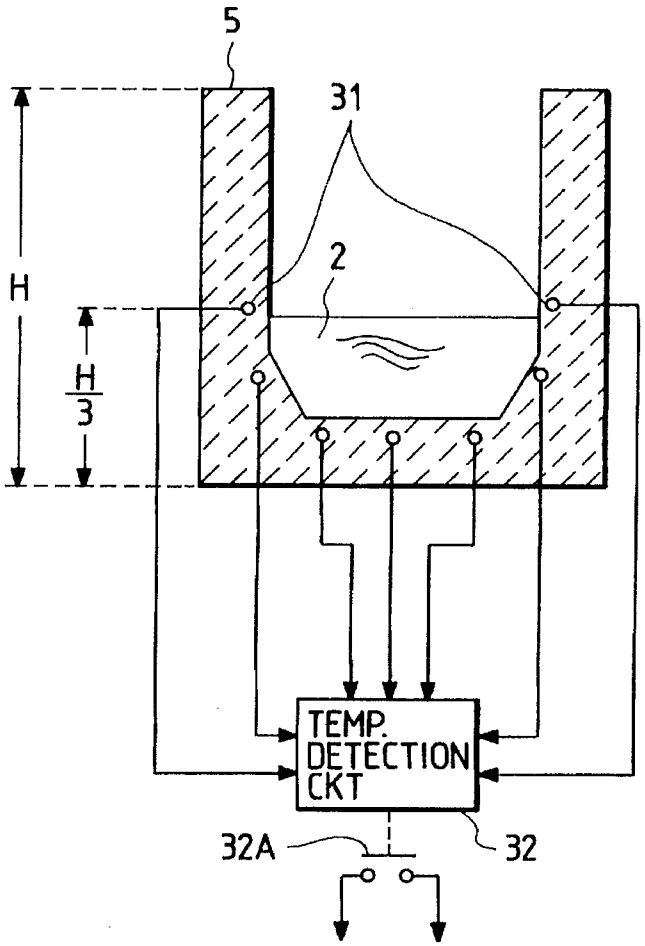
FIG. 2 is a diagram showing the configuration of an induction furnace including a second embodiment of the invention.

FIG. 2 is a diagram showing the configuration of an induction furnace according to a second embodiment of the invention. In the same manner as in the first embodiment of FIG. 1 described above, since the invention is irrelevant to the above-described metal material 3, heat insulating material 6, insulating material 7, coil 8, first antenna 11, second antenna 12, detection power source 13, runout detector 14 and runout alarm contact 14A in the conventional furnace of FIG. 14, these components are not shown in FIG. 2. The name, use and function of temperature sensors 31, a temperature detection circuit 32 and a temperature alarm contact 32A are identical with those in the above-described first embodiment of FIG. 1, and therefore the description of these components is omitted.

The surface of the molten metal 2 is kept at a level equal to or lower than a predetermined level because the induction furnace is tilted to allow the molten metal 2 to be removed therefrom, and also because the induction furnace is required to have a space therein for a metal material 3 to be further supplied. When the height of the furnace body is designated as "H", the surface of the molten metal 2 is usually kept lower than the level of (⅓)H. In the second embodiment, therefore, the positions of the temperature sensors 31 embedded in the refractory material 5 are limited to those lower than the level of one third of the furnace height.

Figure 3:
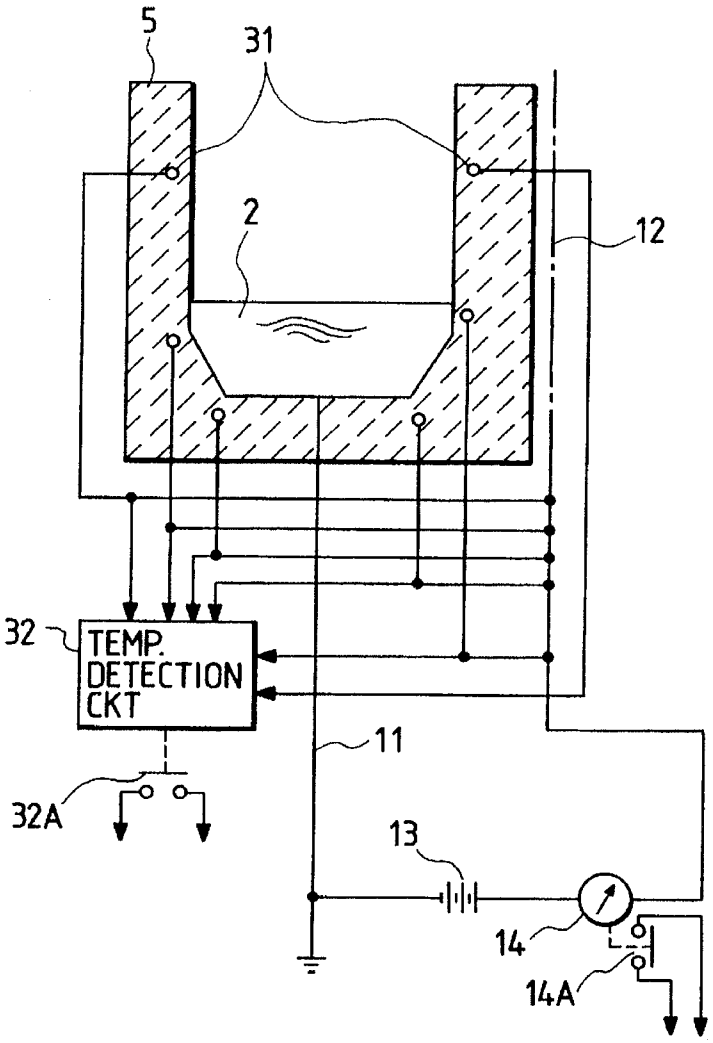
FIG. 3 is a diagram showing the configuration of an induction furnace including a third embodiment of the invention.

FIG. 3 is a diagram showing the configuration of an induction furnace according to a third embodiment of the invention. Since the invention is irrelevant to the above-described metal material 3, heat insulating material 6, insulating material 7 and coil 8 in the conventional furnace of FIG. 14, these components are not shown in FIG. 3. The name, use and function of temperature-sensors 31, a temperature detection circuit 32 and a temperature alarm contact 32A are identical with those of the in the above-described first embodiment of FIG. 1, and therefore the description of these components is omitted.

As the temperature sensors 31, elements by which a temperature is converted into an electric signal to detect the temperature, such as thermocouples, or resistance thermometer elements are usually used. According to the invention, the temperature sensors 31 are connected not only to the temperature detection circuit 32, but also to a second antenna 12 for detecting runout. In this configuration, when the refractory material 5 is damaged, the molten metal 2 first comes into contact with one of the temperature sensors 31, before a hole is made through the furnace wall, to cause the second antenna 12 to detect the runout accident. When the molten metal 2 is brought in contact with the temperature sensor 31, the runout detector 14 detects runout, thereby causing a runout alarm contact 14A to give an alarm.

Figure 4:
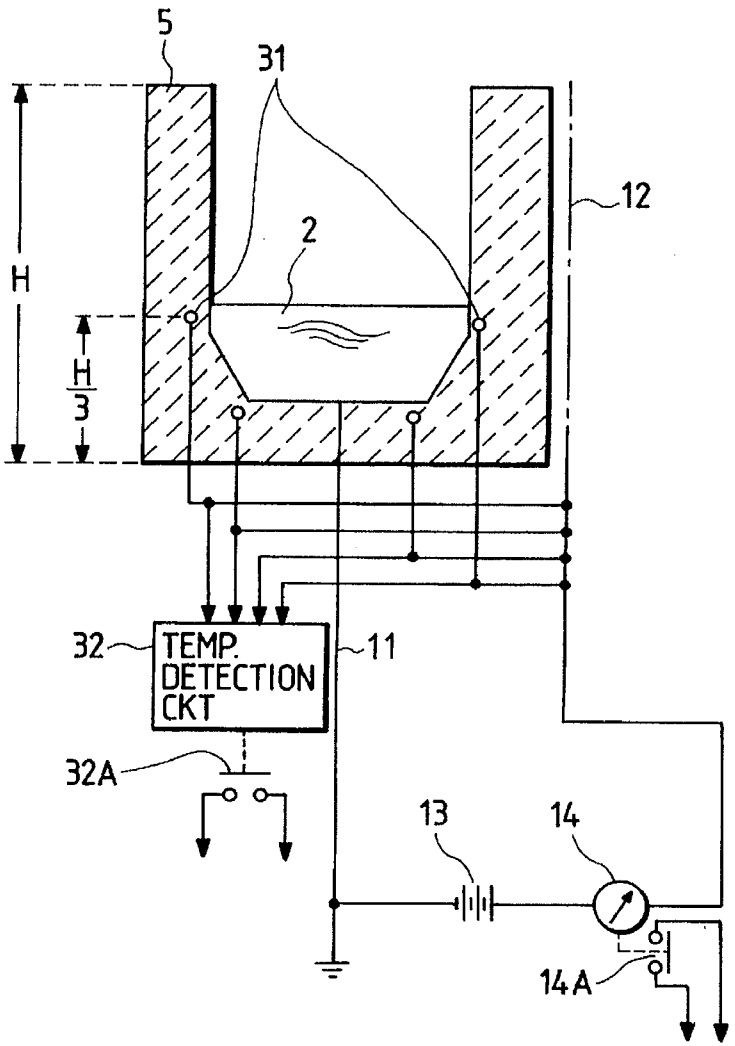
FIG. 4 is a diagram showing the configuration of an induction furnace including a fourth embodiment of the invention.

FIG. 4 is a diagram showing the configuration of an induction furnace according to a fourth embodiment of the invention. The fourth embodiment is different from the above-described third embodiment of FIG. 3 in that the positions of temperature sensors 31 embedded in a refractory material 5 are limited to those lower than the level of one third of the height H of the furnace body. The reason for the provision of the temperature sensors 31 at positions lower than the level of one third of the furnace height has been described above in conjunction with the second embodiment of FIG. 2. Since the fourth embodiment is identical with the above-described third embodiment of FIG. 3 except for the positions of the temperature sensors 31, the detailed description of the fourth embodiment is omitted.

Figure 5:
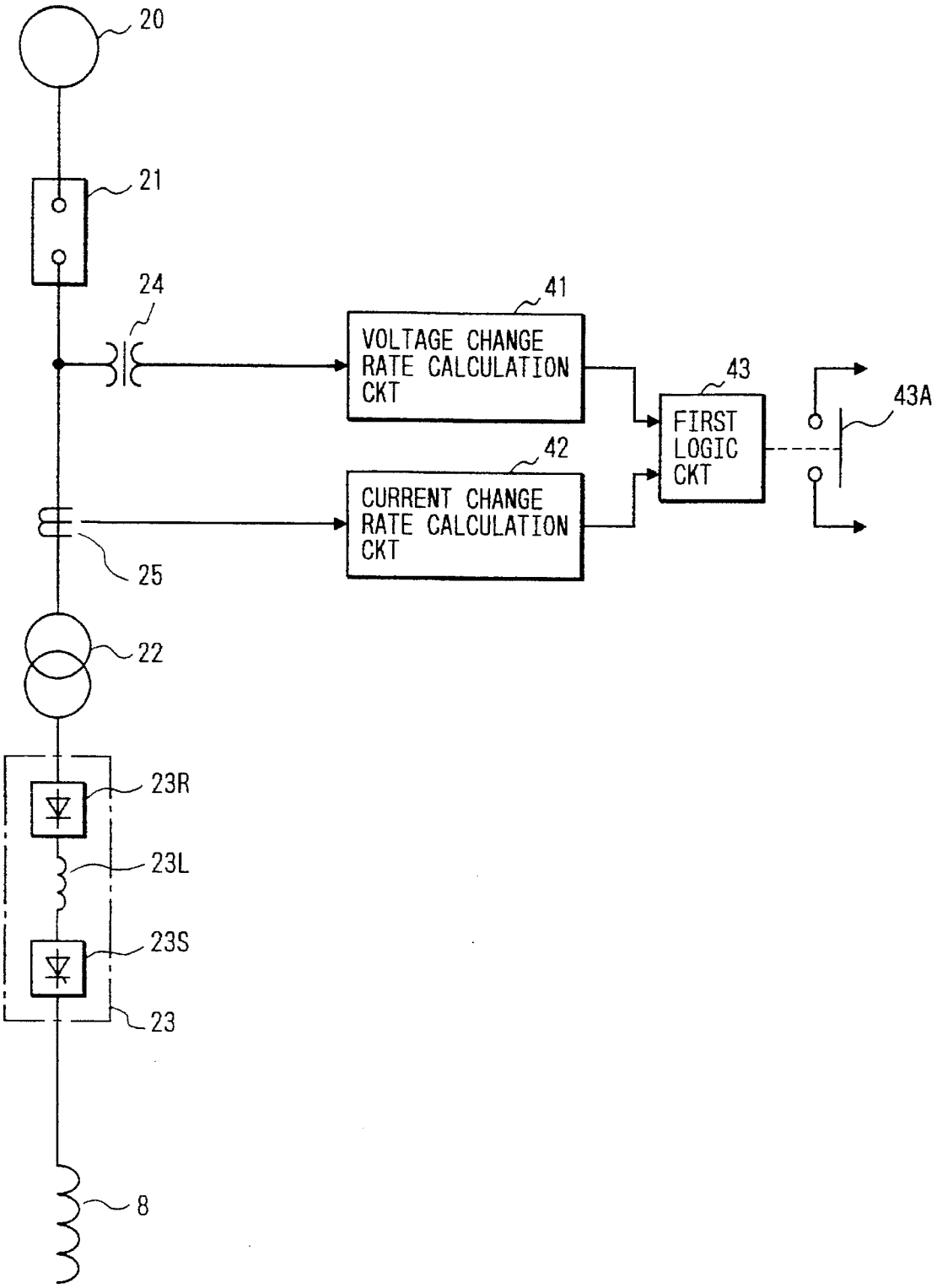
FIG. 5 is a circuit diagram showing a fifth embodiment of the invention.
Figure 15:
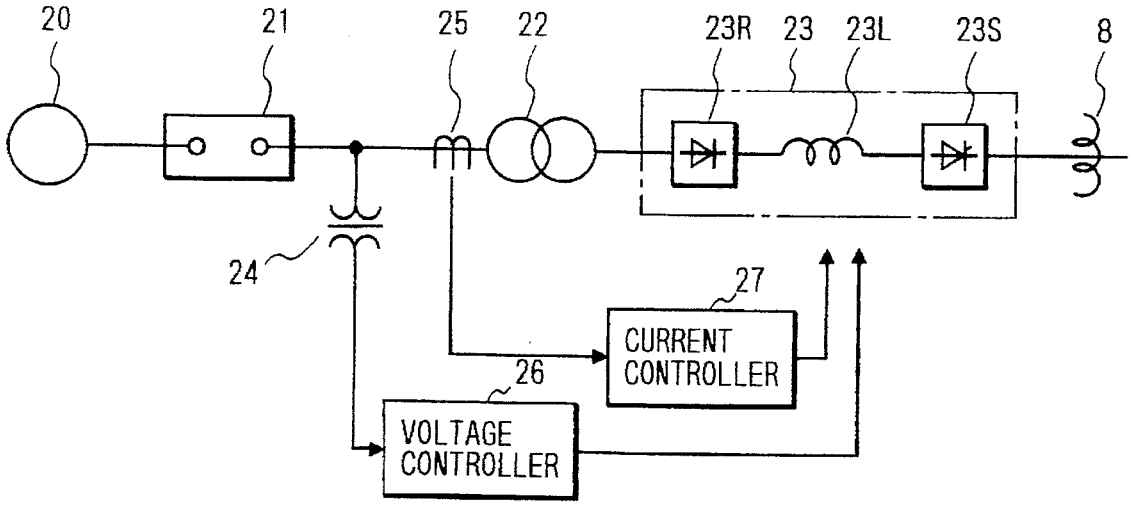
FIG. 15 (PRIOR ART)
FIG. 15 is a circuit diagram showing a prior art example of the electric circuit of the induction furnace.

FIG. 5 is a circuit diagram showing a fifth embodiment of the invention. The name, use and function of a coil 8, an AC power source 20, a breaker 21, a transformer 22, a voltage detector 24, a current detector 25, and an inverter unit 23 consisting of a rectifier 23R, a DC reactor 23L and a thyristor inverter 23S in the circuit of the fifth embodiment of FIG. 5 are identical with those in the circuit of the prior art circuit of FIG. 15 described above, and therefore the description these components is omitted. The levels of the voltage and current are respectively limited to predetermined values by a voltage controller 26 and a current controller 27 which are not shown in FIG. 5.

In the circuit of the fifth embodiment, a voltage-change rate calculation circuit 41 calculates the rate of temporal change in the voltage detected by the voltage detector 24, while a current-change rate calculation circuit 42 calculates the rate of temporal change in the current detected by the current detector 25. The results of these calculation are input to a first logic circuit 43. When the first logic circuit 43 judges that the rate of change in the voltage is kept close to zero for a predetermined time period and the rate of change in the current is also kept close to zero for a predetermined time period, an alarm contact 43A is actuated to give an alarm for notifying that bridging has occurred.

Figure 6:
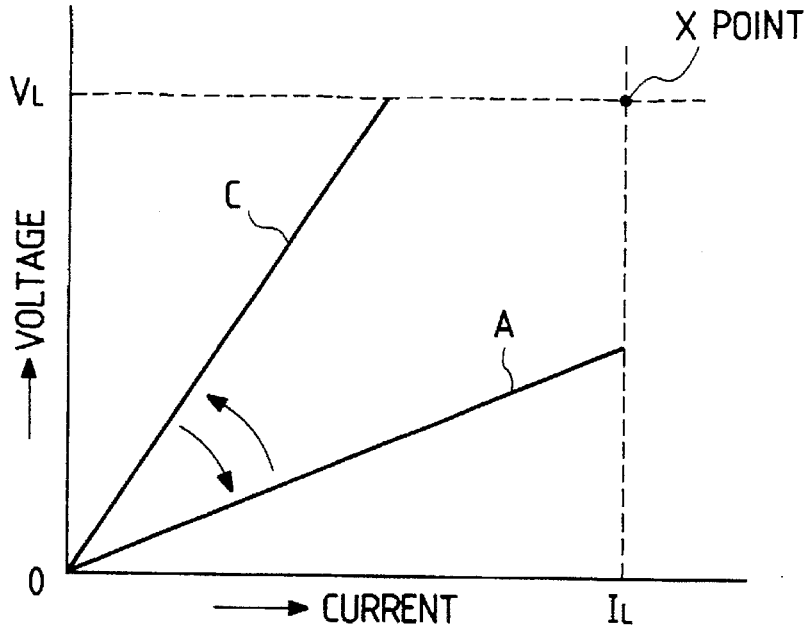
FIG. 6 is a graph showing the operating characteristics of an induction furnace including the circuit of the fifth embodiment as shown in FIG. 5.
Figure 16:
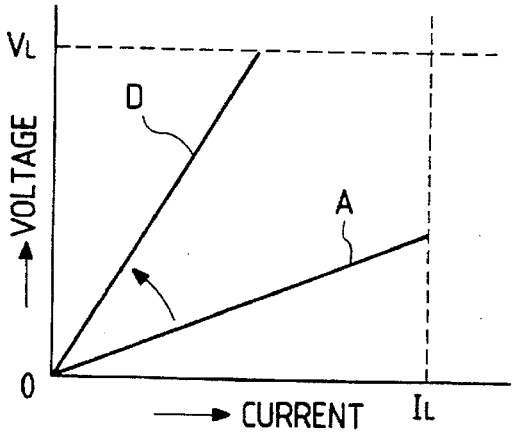
FIG. 16 (PRIOR ART)
FIG. 16 is a graph showing the operating characteristics of the induction furnace of FIG. 14.

FIG. 6 is a graph showing the operating characteristics of an induction furnace having the circuit of the fifth embodiment shown in FIG. 5. The abscissa indicates a current, and $I_L$ represents a current limiting value. The ordinate indicates a voltage, and $V_L$ represents a voltage limiting value. The point determined by the current limiting value $I_L$ and the voltage limiting value $V_L$ is designated as "X". In this graph, the straight line A indicates the operating characteristics obtained when the temperature of the molten metal 2 is low. As the temperature of the molten metal 2 rises, the operating characteristics change into the state indicated by the straight line C. When a metal material 3 falls into the molten metal 2 and the temperature of the molten metal is lowered, the operating characteristics return to the state of the straight line A. Such changes in the operating characteristics are the same as those described above in conjunction with FIG. 16.

Figure 7:
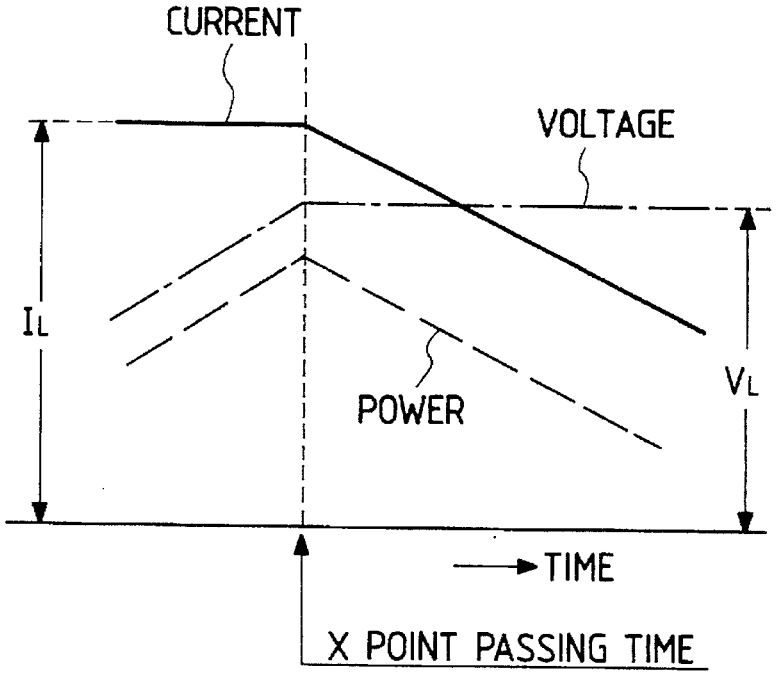
FIG. 7 is a time chart showing changes in voltage, current and power in the case where the operating characteristics shown in FIG. 6 change from the state of the straight line A to that of the straight line D.

FIG. 7 is a time chart showing changes in a voltage, current and power in the case where the operating characteristics change from the state of the straight line A to that of the straight line C. As apparent from FIG. 7, the voltage and the power increase and the current is kept limited to the limiting value $I_L$ until the point determined by the current and voltage in FIG. 6 reaches the point X. Thereafter, the current and the power decrease while the voltage is kept limited to the voltage limiting value $V_L$. In other words, when the induction furnace is in normal operation, either the voltage or the current changes. When the operating characteristics remain in the state of the straight line D as described above in conjunction with FIG. 18 (i.e., when bridging arises in the induction furnace), neither the current nor the voltage changes. This state of the induction furnace is detected by the circuit of the fifth embodiment shown in FIG. 5.

Figure 8:
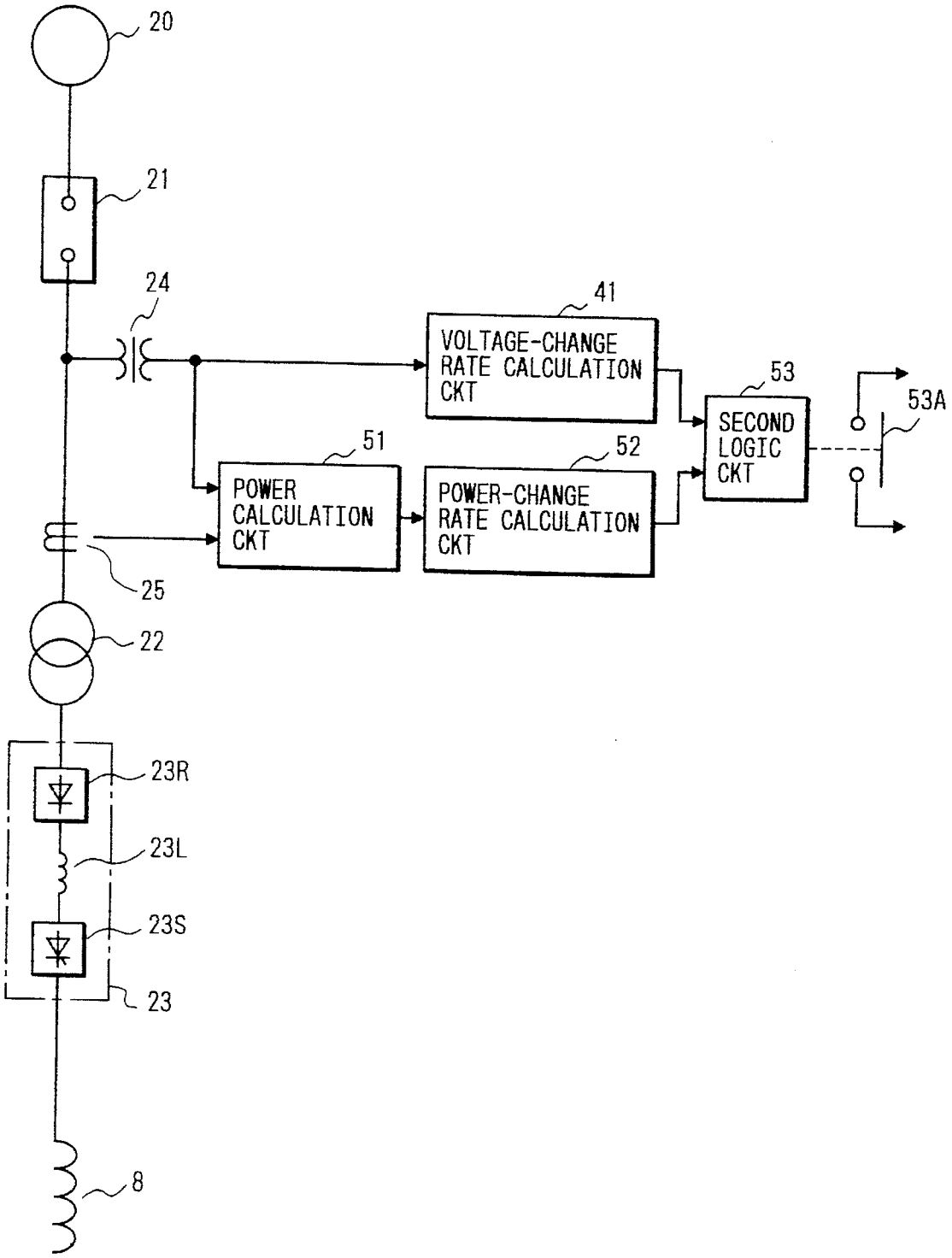
FIG. 8 is a circuit diagram showing a sixth embodiment of the invention.

FIG. 8 is a circuit diagram showing a sixth embodiment of the invention. The name, use and function of a coil 8, an AC power source 20, a breaker 21, a transformer 22, a voltage detector 24, a current detector 25, and an inverter unit 23 consisting of a rectifier 23R, a DC reactor 23L and a thyristor inverter 23S in the circuit of the sixth embodiment of FIG. 8 are identical with those in the prior art circuit of FIG. 15 described above, and therefore the description of these components is omitted. The level of the voltage is limited to a predetermined value by a voltage controller 26 which is not shown in FIG. 8.

In the circuit of the sixth embodiment, a voltage-change rate calculation circuit 41 calculates the rate of temporal change in the voltage detected by the voltage detector 24. The values of the voltage and current respectively detected by the voltage detector 24 and the current detector 25 are input to a power calculation circuit 51 which in turn calculates the value of the electric power. Then, a power-change rate calculation circuit 52 calculates the rate of temporal change in the calculated power. The calculated rates of change in the voltage and in the electric power are input to a second logic circuit 53 which judges whether both the input rates are kept close to zero for a predetermined time period. When both the input rates are kept close to zero for the predetermined time period, an alarm contact 53A is actuated to give an alarm for notifying that bridging has occurred.

Figure 9:
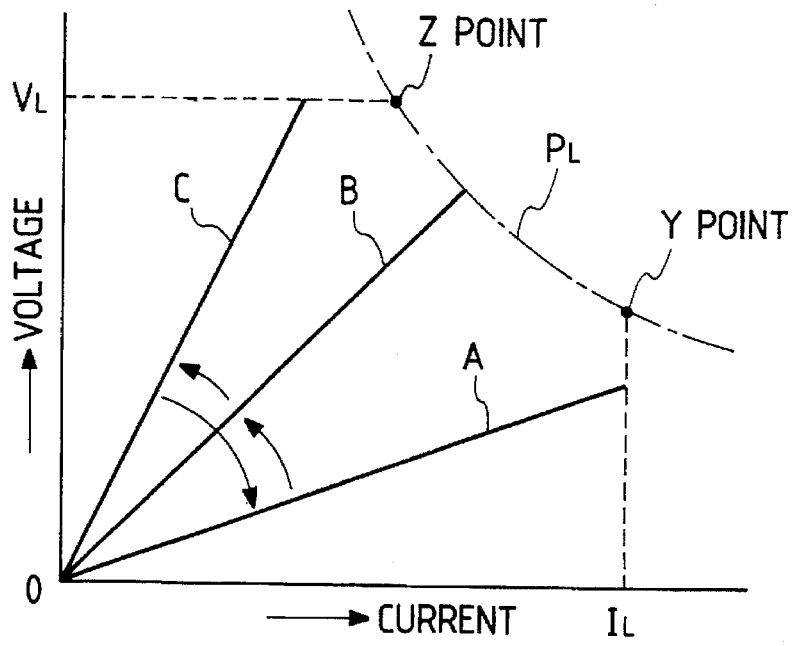
FIG. 9 is a graph showing the operating characteristics of an induction furnace including the circuit of the sixth embodiment as shown in FIG. 8.

FIG. 9 is a graph showing the operating characteristics of an induction furnace having the circuit of the sixth embodiment shown in FIG. 8. The abscissa indicates a current, and $I_L$ represents a current limiting value. The ordinate indicates a voltage, and $V_L$ represents a voltage limiting value. The dash-dot curve represents a power limiting value $P_L$. The point determined by the current limiting value $I_L$ and the power limiting value $P_L$ is designated as "Y", and the point determined by the voltage limiting value $V_L$ and the power limiting value $P_L$ is designated as "Z". In this graph, the straight line A indicates the operating characteristics obtained when the temperature of the molten metal 2 is low. As the temperature of the molten metal 2 rises, the operating characteristics change from the state of the straight line A to that of the straight line B, and then to that of the straight line C. When a metal material 3 falls into the molten metal 2 and the temperature of the molten metal is lowered, the operating characteristics return to the state of the straight line A. Such changes in the operating characteristics are the same as those described above in conjunction with FIG. 16.

Figure 10:
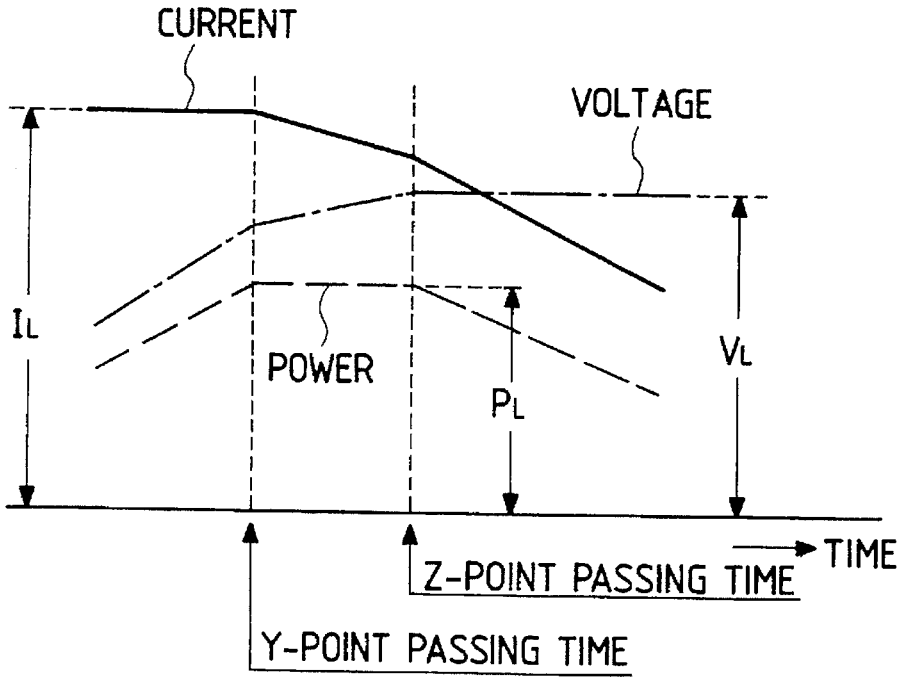
FIG. 10 is a time chart showing changes in voltage, current and power in the case where the operating characteristics shown in FIG. 9 change from the state of the straight line A to that of the straight line B, and then to that of the straight line C.

FIG. 10 is a time chart showing changes in a voltage, current and power in the case where the operating characteristics change from the state of the straight line A to that of the straight line B, and then to that of the straight line C. As apparent from FIG. 10, the voltage and the power increase and the current is kept limited to the limiting value $I_L$ until the point determined by the current and voltage in FIG. 9 reaches the point Y. Thereafter, the current decreases, the voltage increases, and the power is kept limited to the power limiting value $P_L$ until the point determined by the current and voltage in FIG. 9 reaches the point Z. Thereafter, the current and the power decrease while the voltage is kept limited to the voltage limiting value $V_L$. In other words, when the induction furnace is in normal operation, two of the three kinds of electrical data, i.e., two of the voltage, the current and the power change. Thus, when the operating characteristics remain in the state of the straight line D as described above in conjunction with FIG. 18 (i.e., when bridging arises in the induction furnace), neither the power nor the voltage changes. This state of the induction furnace is detected by the circuit of the sixth embodiment shown in FIG. 8.

In the circuit of the sixth embodiment shown in FIG. 8, the occurrence of bridging is detected from the rates of change in power and voltage. But it should be understood that the rates of change in power and current may be used to detect the occurrence of bridging.

Figure 11:
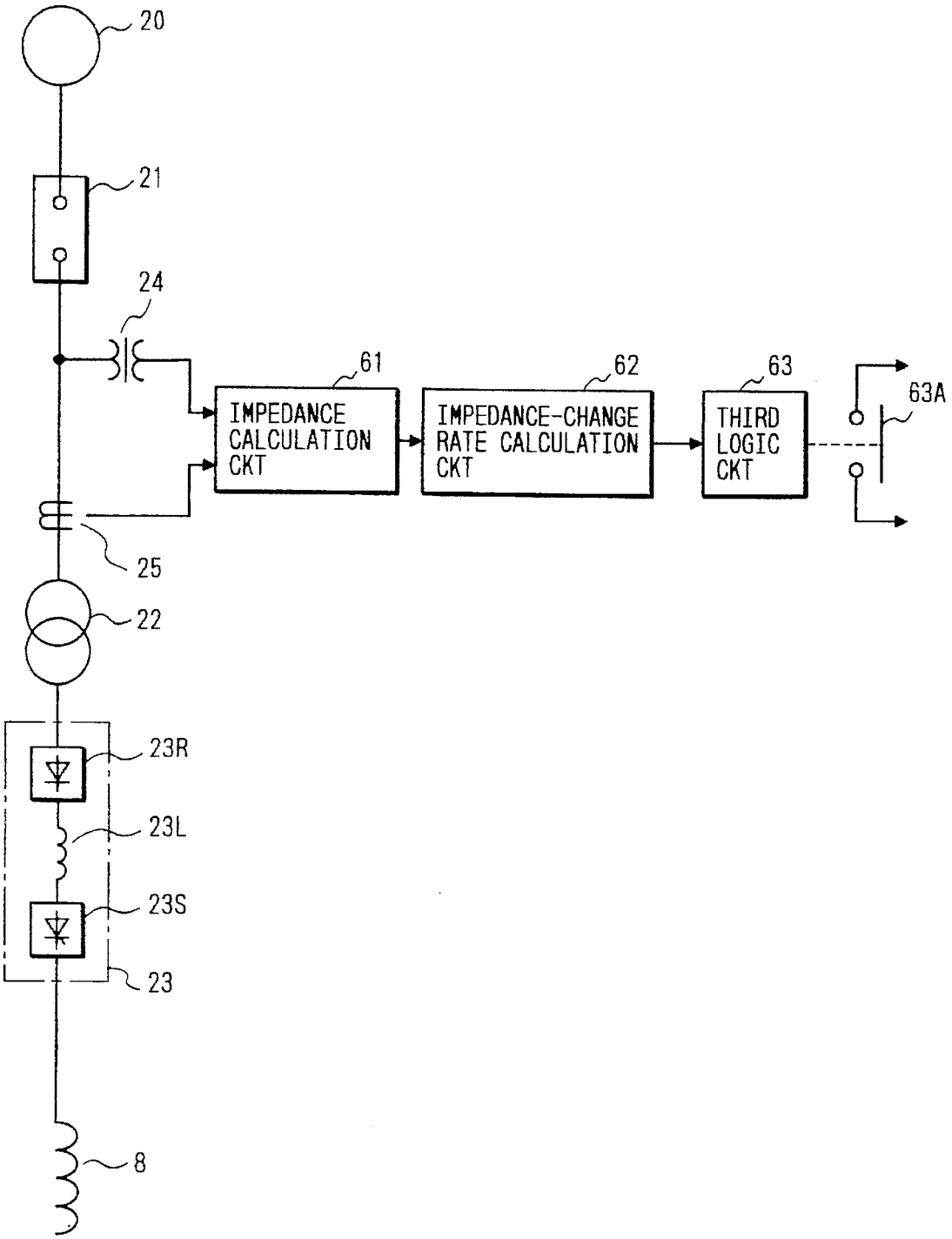
FIG. 11 is a circuit diagram showing a seventh embodiment of the invention.

FIG. 11 is a circuit diagram showing a seventh embodiment of the invention. The name, use and function of a coil 8, an AC power source 20, a breaker 21, a transformer 22, a voltage detector 24, a current detector 25, and an inverter unit 23 comprising a rectifier 23R, a DC reactor 23L and a thyristor inverter 23S in the circuit of the seventh embodiment of FIG. 11 are identical with those in the prior art circuit of FIG. 15 described above, and therefore the description of these components is omitted.

Figure 18:
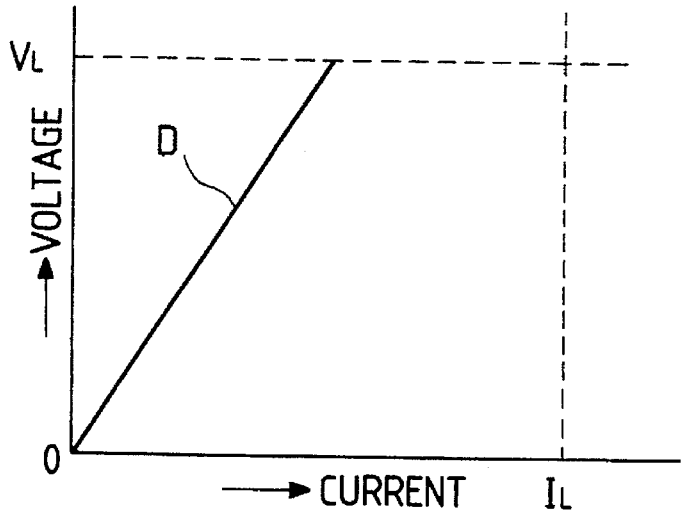
FIG. 18 (PRIOR ART)
FIG. 18 is a graph showing the operating characteristics of the induction furnace in which bridging has occurred as shown in FIG. 17.

In the circuit of the seventh embodiment shown in FIG. 11, an impedance calculation circuit 61 calculates the impedance from the detected voltage and current. Then, an impedance-change rate calculation circuit 62 calculates the rate of temporal change in the calculated impedance. The straight line D shown in the above-described graph of FIG. 18 represents the impedance. A third logic circuit 63 judges whether the rate of change in impedance is kept at about zero for a predetermined time period, i.e., whether the impedance remains unchanged. The fact that the impedance remains unchanged indicates that neither the current nor the voltage changes. This means that bridging has occurred in the induction furnace. When such a state is detected by the third logic circuit 63, therefore, an alarm contact 63A is actuated to give an alarm.

Figure 12:
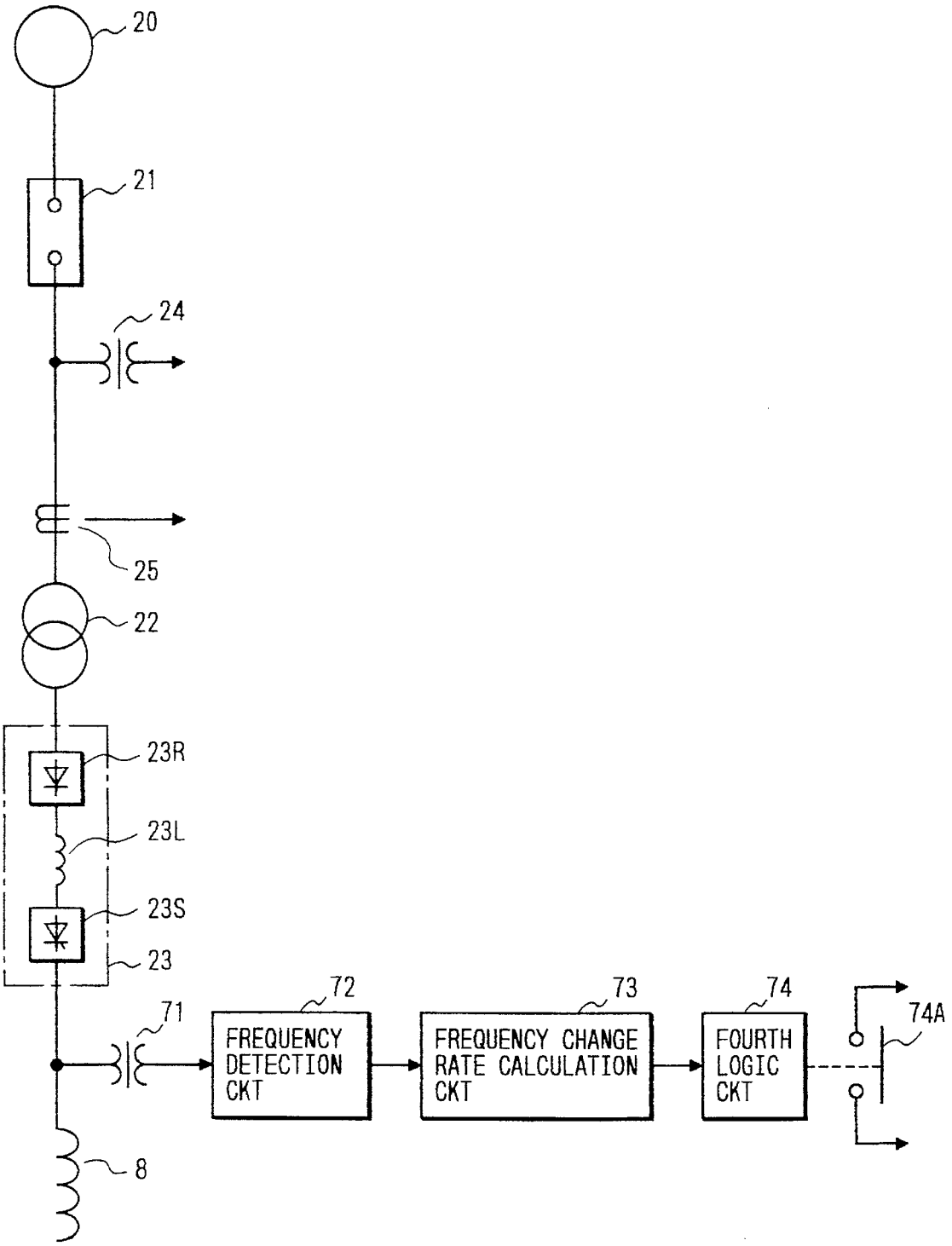
FIG. 12 is a circuit diagram showing an eighth embodiment of the invention.

FIG. 12 is a circuit diagram showing an eighth embodiment of the invention. The name, use and function of a coil 8, an AC power source 20, a breaker 21, a transformer 22, a voltage detector 24, a current detector 25, and an inverter unit 23 comprising a rectifier 23R, a DC reactor 23L and a thyristor inverter 23S in the circuit of the eighth embodiment of FIG. 12 are identical with those in the prior art circuit of FIG. 15 described above, and therefore the description of these components is omitted.

In the circuit of the eighth embodiment shown in FIG. 12, a frequency detection circuit 72 which is connected to a voltage detector 71 for detecting the voltage to be applied to the coil 8 detects the frequency of the AC current to be supplied to the coil 8. Then, a frequency-change rate calculation circuit 73 calculates the rate of temporal change in frequency. The impedance of the coil 8 is proportional to the product of the inductance of the coil and the frequency. Thus, the fact that the frequency remains unchanged indicates that the impedance remains unchanged. This means that, in the same manner as in the seventh embodiment described above, bridging has occurred in the induction furnace. Thus, when such a state is detected, an alarm contact 74A is actuated to give an alarm.

FIG. 13 is a circuit diagram showing a ninth embodiment of the invention. The name, use and function of a coil 8, an AC power source 20, a breaker 21, a transformer 22, a voltage detector 24, a current detector 25, and an inverter unit 23 consisting of a rectifier 23R, a DC reactor 23L and a thyristor inverter 23S in the circuit of the ninth embodiment of FIG. 13 are identical with those in the prior art circuit of FIG. 15 described above, and therefore the description of these components is omitted.

In the circuit of the ninth embodiment shown in FIG. 13, the voltage detected by the voltage detector 24 and the current detected by the current detector 25 are input to a data calculation circuit 81 which in turn detects and calculates various electrical data (including the power, frequency, power factor, etc. in addition to the current and the voltage). In a memory 82, standard values of various electrical data for the operation of the induction furnace are stored in accordance with the elapse of operating time. These stored data are read out as memory data from the memory 82 in response to clock instructions given from a clock 83. The memory data and the detected data obtained by the data calculation circuit 81 are input to a data deviation detecting circuit 84 which in turn compares these two sets of data and determines the deviation of the detected data from the memory data. When a fifth logic circuit 85 judges that this deviation is kept larger than a predetermined value for a predetermined time period, it actuates an alarm contact 85A to give an alarm.

When the lumps of a metal material fed into an induction furnace are intertwined to be kept from falling into the molten metal, i.e., when so-called bridging arises in the induction furnace, the electric energy supplied to the induction furnace is not supplied to the metal material, but supplied only to the molten metal, so that the molten metal is heated to an extremely high temperature. The molten metal heated to such an extremely high temperature damages the refractory material constituting the furnace body, or in the worst case, makes a hole through the refractory material, thereby causing the danger of a runout accident. Conventional techniques rely only on visual inspection to judge whether bridging of the metal material has occurred or not. But visual inspection is difficult in the poor and dangerous work environment. Furthermore, it is impossible to perform visual inspection in a closed-type induction furnace.

According to one aspect of the invention, therefore, a plurality of temperature sensors such as thermocouples or resistance thermometer elements are embedded at appropriate positions in the refractory material constituting the furnace body (which appropriate positions are, for example, those in the entire furnace body or those lower than the surface level of the molten metal). Accordingly, an unusual increase in the temperature of the molten metal can be immediately detected, thereby attaining the effect that the refractory material can be prevented from being damaged.

According to another aspect of the invention, the above-mentioned temperature sensors embedded in the refractory material are connected to an antenna for detecting runout in the induction furnace. Therefore, an unusual increase in the temperature of the molten metal can be detected. Furthermore, a runout alarm is given when the refractory material is damaged to cause the molten metal to contact with any of the temperature sensors. Therefore, the runout alarm is given before a hole is made through the wall of the furnace. In this manner, runout detection means is duplicated so that the reliability of the detection is improved, and furthermore, the invention attains the effect that a terrible accident can be prevented by the early detection of runout.

According to a further aspect of the invention, since various electrical data change with time during the process of melting a metal material into a molten metal and further raising the temperature of the molten metal, the presence of a metal material kept from falling into the molten metal, i.e., the occurrence of bridging is detected when it is found that a part or the whole of the electrical data substantially remain unchanged for a predetermined time period. Therefore, the invention attains the effect that the occurrence of bridging can be detected by a circuit of simple construction, without requiring visual inspection.

According to a still further aspect of the invention, various electrical data of the standard operation of the induction furnace and in accordance with the elapse of time are previously stored in the storage means, and the stored electrical data are compared with various electrical data actually detected in the induction furnace in operation. When the deviation of the detected data from the stored data is kept equal to or larger than a predetermined value for a predetermined time period it is judged that bridging has occurred. Thus, the invention attains the effect that the occurrence of bridging can be detected by a circuit of simple construction, without requiring visual inspection.

What is claimed is:

1. A bridging protection apparatus for an induction furnace which includes a furnace body having a peripheral side wall and a bottom wall which are made of a refractory material; a coil-like conductor disposed around an outer periphery of said furnace body; an alternating current source connected to said coil-like conductor; and voltage limiting means and current limiting means for respectively limiting the levels of the voltage and current supplied from said alternating current source to predetermined values, in which a current flows through said coil-like conductor to effect induction heating in a metal fed into an inner space of said furnace body, said apparatus comprising:

voltage detection means coupled to detect the voltage supplied from said alternating current source to said coil-like conductor;

current detection means coupled to detect the current supplied from said alternating current source to said coil-like conductor;

voltage-change rate calculation means, coupled to receive a voltage detection signal from said voltage detection means, for calculating a rate of temporal change in the supplied voltage;

current-change rate calculation means, coupled to receive a current detection signal from said current detection means, for calculating a rate of temporal change in the supplied current;

a logic circuit, coupled to receive as input values the calculated rates of temporal change in the voltage supplied from the voltage-change rate calculation means and the current supplied from the current-change rate calculation means, for judging whether both of the input values are kept equal to or lower than predetermined values for a predetermined time period; and means for generating an alarm in response to an output signal from said logic circuit.

2. A bridging protection apparatus for an induction furnace which includes a furnace body having a peripheral side wall and a bottom wall which are made of a refractory material; a coil-like conductor disposed around an outer periphery of said furnace body; an alternating current source connected to said coil-like conductor; and voltage limiting means, current limiting means and power limiting means for respectively limiting the levels of the voltage, current and power supplied from said alternating current source to predetermined values, a current flowing through said coil-like conductor to effect induction heating in a metal fed into an inner space of said furnace body, said apparatus comprising:

voltage detection means coupled to detect the voltage supplied from said alternating current source to said coil-like conductor;

current detection means coupled to detect the current supplied from said alternating current source to said coil-like conductor;

power calculation means, coupled to receive a voltage detection signal from said voltage detection means and a current detection signal from said current detection means, for calculating the supplied power from the detected voltage and the detected current;

power-change rate calculation means, coupled to receive a power calculation signal from said power calculation means, for calculating a rate of temporal change in the supplied power;

rate calculation means, coupled to receive one of the voltage detection signal and the current detection signal, for calculating a rate of temporal change in one of the supplied voltage and the supplied current;

a logic circuit, coupled to receive as input values the calculated rates of temporal change in the supplied power and in the one of the supplied voltage and supplied current, for judging whether both of the input values are kept equal to or lower than a predetermined value for a predetermined time period; and means for generating an alarm in response to an output signal from said logic circuit.

* * * * *

US005661750A

United States Patent [19]

Fulton

[11] Patent Number: 5,661,750

[45] Date of Patent: Aug. 26, 1997

[54] DIRECT SEQUENCE SPREAD SPECTRUM SYSTEM

[75] Inventor: Forrest F. Fulton, Los Altos Hills, Calif.

[73] Assignee: CellNet Data Systems, Inc., San Carlos, Calif.

[21] Appl. No.: 473,011

[22] Filed: Jun. 6, 1995

[51] Int. Cl.[6] ..... H04K 1/00

[52] U.S. Cl. ..... 375/208; 375/367; 375/206

[58] Field of Search ..... 375/200, 354, 375/206, 208, 279, 295, 316, 329, 367; 364/717; 327/164; 370/105.1, 18

[56] References Cited

U.S. PATENT DOCUMENTS

| | | | |
|---|---|---|---|
| 4,112,368 | 9/1978 | Ewanus et al. | 375/200 |
| 4,297,700 | 10/1981 | Nard et al. | 342/125 |
| 4,665,404 | 5/1987 | Christy et al. | 342/463 |
| 4,930,139 | 5/1990 | Chandler et al. | 375/1 |
| 4,969,159 | 11/1990 | Belcher et al. | 375/1 |
| 5,309,474 | 5/1994 | Gilhousen et al. | 375/1 |
| 5,341,423 | 8/1994 | Nossen | 375/200 |
| 5,469,468 | 11/1995 | Schilling | 375/202 |

*Primary Examiner*—Tesfaldet Bocure
*Attorney, Agent, or Firm*—Fish & Richardson, P.C.

[57] ABSTRACT

A direct-sequence spread spectrum communication system using a high power transmitter and a short spreading sequence which still satisfies FCC Rule 15.247 regarding power density. In addition to the spreading sequence, the carrier signal is modulated with a phase reversal sequence. Typically, each period of the phase reversal sequence has a duration equal to the total duration of the spreading sequence. The phase reversal sequence reduces the maximum power density of the signal, but is transparent to a receiver.

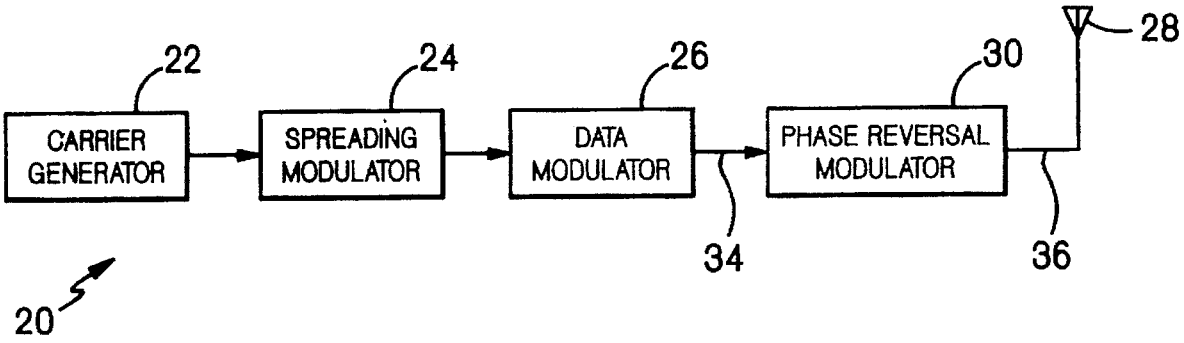

37 Claims, 9 Drawing Sheets